United States Patent [19]

Leger et al.

[11] 4,204,803

[45] May 27, 1980

[54] DIAPHRAGM SUPPORT

[75] Inventors: Donald R. Leger, Westminster; Peter P. Clifford, Leominster; William N. Matson, Fitchburg, all of Mass.

[73] Assignee: General Electric Company, Schenectady, N.Y.

[21] Appl. No.: 926,799

[22] Filed: Jul. 21, 1978

[51] Int. Cl.[2] ..... F01D 25/24

[52] U.S. Cl. ..... 415/219 R

[58] Field of Search ..... 415/199.4, 199.5, 216, 415/217, 218, 219 R, 126, 136, 137, 139; 248/554, DIG. 1

[56] References Cited

U.S. PATENT DOCUMENTS

| | | | |
|---|---|---|---|
| 2,247,387 | 7/1941 | Johnson et al. | 415/219 R |
| 2,247,423 | 7/1941 | Webster, Jr. | 415/219 R |
| 3,861,827 | 1/1975 | Peabody et al. | 415/219 R |
| 3,947,150 | 3/1976 | Lohonen | 415/219 R |

FOREIGN PATENT DOCUMENTS

| | | | |
|---|---|---|---|
| 1027515 | 4/1958 | Fed. Rep. of Germany | 415/219 R |

*Primary Examiner*—Leonard E. Smith

*Attorney, Agent, or Firm*—James W. Mitchell; John F. Ahern

[57] ABSTRACT

A support arrangement is disclosed for supporting an annular diaphragm in a turbine casing. The support arrangement allows the diaphragm to be vertically aligned with respect to the turbine casing and rotor and comprises in its most basic form the combination of a horizontally mounted bifurcated lug and a vertically mounted dumbbell shaped adjusting screw.

1 Claim, 6 Drawing Figures

DIAPHRAGM SUPPORT

BACKGROUND OF THE INVENTION

This invention relates in general to turbomachines and is specifically directed to an arrangement for supporting an annular diaphragm half within a turbomachine.

Turbomachines generally comprise stationary and rotating parts defining a flow path for fluid through the turbine. Turbomachines also include an outer fluid tight casing called an outer shell from which a number of stationary parts generally depend radially inwardly toward a rotor surface. One such part is a diaphragm and each turbomachine may have a number of diaphragms spaced axially along the length of the turbomachine.

A turbomachine casing may be split along a so-called horizontal joint so that the turbine shell comprises an upper half and a lower half. In building a turbomachine, certain stationary parts are mounted in the lower half shell whereas other stationary parts are mounted in the upper half shell while the two mating components are kept apart. The two halves are then assembled along a horizontal joint after the rotor has been mounted in the lower half.

Diaphragms may likewise be split along a horizontal joint and comprise upper and lower diaphragm halves. The diaphragm halves are each mounted in their respective casing parts. It is necessary to vertically align the diaphragm half with the rotor and its respective casing part. The present invention provides a relatively simple arrangement of parts for adjustably supporting an annular diaphragm in its respective casing part.

OBJECTS OF THE INVENTION

It is one object of the present invention to provide an improved diaphragm support arrangement in a turbomachine casing.

It is another object of the present invention to provide an improved diaphragm support arrangement which is vertically adjustable within the turbine casing.

Other objects and advantages will become apparent from the following detailed description of the invention and the novel features will be particularly pointed out hereinafter in the claims.

BRIEF DESCRIPTION OF THE INVENTION

The invention is a support arrangement whereby a diaphragm half can be adjustably mounted into a casing half. The mounting points are at the horizontal joint on each side of the turbine casing. A pair of support lugs are radially inserted into the diaphragm half one on each side of the diaphragm vertical centerline. The support lugs are unique in that they are each formed with a bifurcated head. An adjusting screw is inserted into the turbine shell in a substantially vertical direction on each side of the turbine casing. The adjusting screw is uniquely formed so as to engage the bifurcated head of its respective support lug whereby the diaphragm may be adjusted as the adjusting screw is leveled. After a satisfactory diaphragm position has been attained the assembled components can be locked together by means of a locking tab on the adjusting screw.

DETAILED DESCRIPTION OF THE INVENTION

A turbomachine is any machine comprising a fluid tight casing into which there are mounted stationary components and a rotor and wherein the fluid passes through the casing and either is compressed or expanded. The stationary components and the rotor are interacted in a known manner so as to define a fluid flow path. It is also familiar to those of ordinary skill in the art that the most advantageous method for constructing a turbomachine is to build the outer shell in two halves which will thereafter be assembled along a horizontal joint. The stationary components are each mounted in their respective turbine casing halves and then the rotor is mounted in the lower casing half after which the two halves are joined and bolted. This general construction is well known and needs no further description.

Figure 1:
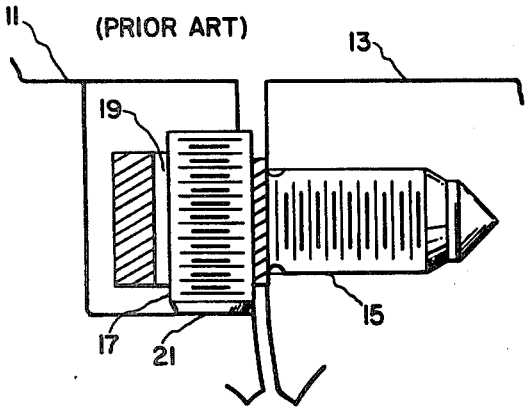
FIG. 1 is an elevation view of a support arrangement for a diaphragm within a turbomachine casing lower half according to the prior art.

FIG. 1 shows a prior art arrangement for assembling a lower half stationary part to a casing shell. FIG. 1 shows a section of the lower turbomachine casing 11 and a section of an annular diaphragm 13 which is also split along a horizontal joint and therefore only the lower half is shown. It should also be kept in mind that the support arrangement shown is only one half of the total support arrangement with an identical arrangement being placed on the opposite side of the turbomachine shell. Hence, at least two support joints are involved with each diaphragm half. The support arrangement for each side comprises a generally horizontal support lug 15 and a generally vertical adjusting screw 17. The adjusting screw is inserted into a bore 19 formed in the head of the support lug in order to vertically adjust the position of the diaphragm. The adjusting screw merely bears against the turbomachine casing at surface 21. One shortcoming of the FIG. 1 embodiment is that it is not suitable for attaching upper diaphragm halves to upper casings. This is due to the fact that adjusting screw 17 is not a holding screw in that it does not retain the diaphragm in the turbomachine casing. In following the assembly procedure of a turbine, the upper casing half is inverted to be assembled to the lower casing half and if that were done to the FIG. 1 representation, the diaphragm would simply fall out of the casing as it was inverted. Another shortcoming of the FIG. 1 embodiment is that thermal expansion causes the adjustment screw 17 to slide against surface 21 causing wear on the casing.

Figure 2:
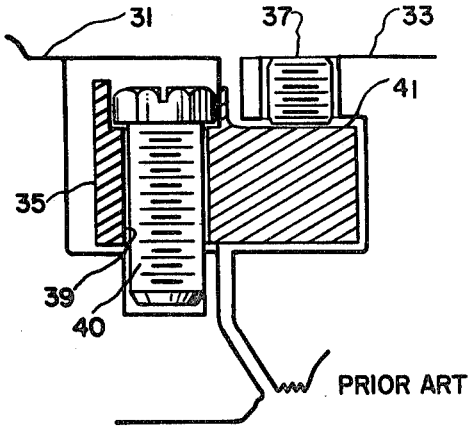
FIG. 2 is an elevation view of a support arrangement for a diaphragm within a turbomachine casing upper half according to the prior art.

FIG. 2 shows an upper casing half 31 and a section of an upper diaphragm section 33. The orientation shown is prior to assembly to the lower casing half and hence prior to the inverting of the upper casing. A support lug 35 is an "L" shaped piece which supports the diaphragm 33 and forms a base for an adjusting screw 37. The support lug further includes a bore 39 into which a holding bolt 40 is inserted. The holding bolt then ties the diaphragm support arrangement to the casing so that when the upper casing half is inverted for assembly the upper diaphragm half will not be displaced. Note that radial expansion will still cause adjusting screw 37 to slide on the bearing surface 41, which occurs this time on the support lug.

The separate aforesaid disadvantages are obviated by the present invention which also requires fewer parts and is universal to both the upper and lower casing parts. Further, another disadvantage to the prior art which has now been obviated is described as follows. In the prior art when the embodiments of FIGS. 1 and 2 where used together sometimes during disassembly the upper and lower diaphragms would be locked together. Consequently, as the upper casing half was removed for disassembly, the lower diaphragm half would be drawn upwardly with the upper casing creating the possibility of damage to the rotor and/or the diaphragm.

Figure 3:
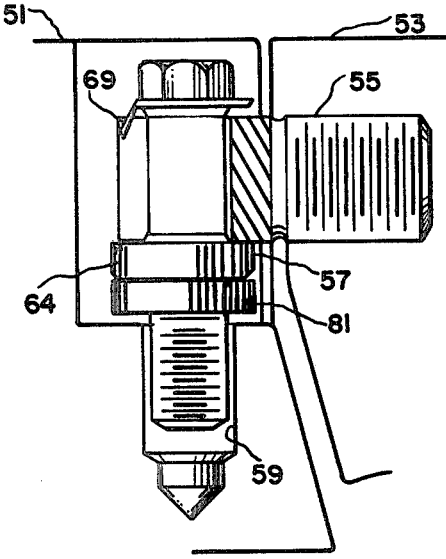
FIG. 3 is an elevation view, similar to FIG. 1, which shows a diaphragm support arrangement according to the present invention which may be used for both upper and lower diaphragm supports.
Figure 4:
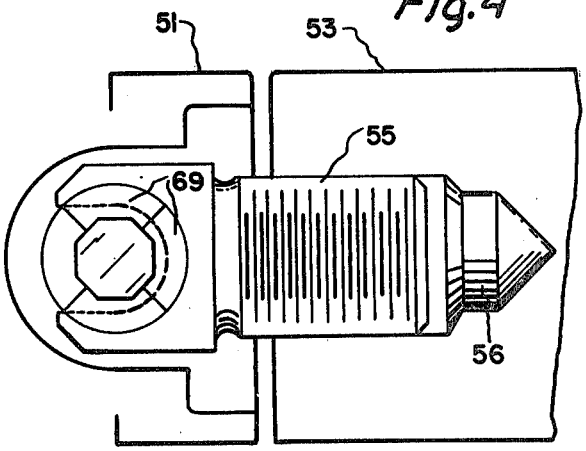
FIG. 4 is a plan view of the present invention.

FIGS. 3 and 4 are assembly drawings showing one support point in a turbine casing. It should be understood that the support arrangement will be used to support a semiannular diaphragm section in each side of the lower turbomachine casing and likewise be able to support the annular diaphragm on each side of the upper turbomachine casing including when the turbomachine casing must be overturned as to be mounted on the lower turbomachine casing. One advantage immediately apparent in the present invention is that only two pieces are required rather than three pieces to complete the assembly. The "L" shaped lug has been omitted and moreover the cut-out portion in the diaphragm has also been obviated. A further advantage is that the present invention will be universal to both the upper and lower casing halves.

FIG. 3 is an elevation view of a portion of a turbomachine casing half and a portion of the diaphragm is mounted in the turbomachine casing half. FIG. 4 is a plan view of the same assembly. Referring to FIGS. 3 and 4, a diaphragm half 53 is to be mounted to a portion of a turbomachine casing 51. This is accomplished by using a horizontally mounted support lug 55 which is threaded into the diaphragm at hole 56. Again, it is understood that only one mounting point is shown, whereas the turbomachine would include two oppositely located mounting points in the lower casing half and two oppositely located mounting points in the upper casing half. An adjustment screw 57 is vertically mounted into the turbine casing in a threaded hole 59. The adjusting screw 57 is vertically adjustable.

Figure 5:
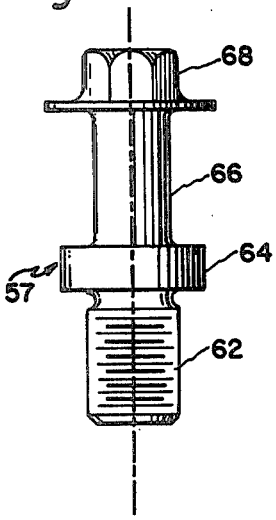
FIG. 5 is an elevation view of the adjusting screw according to the present invention.
Figure 6:
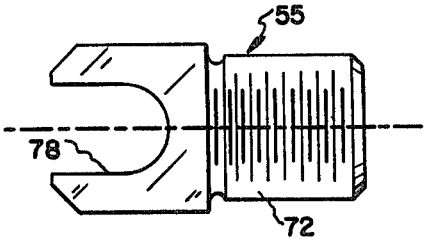
FIG. 6 is an elevation view of the support lug according to the present invention.

Referring to FIGS. 5 and 6, FIG. 5 shows the adjusting screw whereas FIG. 6 shows the support lug. The adjusting screw 57 includes a threaded base 62 which is threaded into the turbine casing. This allows a positive retention of the diaphragm within the turbine casing. The adjusting screw further includes an enlarged platform bearing surface 64, a reduced section 66 and a cap section 68. The support lug 55 is formed with a threaded section 72 and a bifurcated head 78. The adjusting screw 57 and the support lug 55 are arranged during the assembly procedure so that the bifurcated head 78 is supported on the enlarged bearing platform 64 of the adjusting screw and further so that the bifurcated head 78 engages the reduced section 66 of the adjusting screw. In this manner, as the adjusting screw is moved vertically the support lug will follow the movement of the adjusting screw as well as the diaphragm to which the support lug is attached. The horizontal clearances between the adjusting screw and the support lug are such as to allow for radial expansion whereas the bifurcated head permits limited radial movement.

As shown in FIGS. 3 and 4, the cap portion 68 of the adjusting screw is formed in sections 69 which are bendable so as to engage the bifurcated head of the support lug whereby a locking arrangement is achieved between the adjusting screw and the support lug. A spacer 81 may be employed between the enlarged bearing platform 64 and the turbomachine shell 51 so as to limit the deflection of the diaphragm in the environment in which the present invention is employed.

Thus the present invention provides numerous improvements in a diaphragm support arrangement in a turbomachine casing. The construction reduces the number of overall parts while providing a universal mounting for both the upper and lower diaphragms. Moreover, thermal expansion is accommodated by the use of a bifurcated head on the support lug. The locking tab 69 on the adjustment screw provides positive locking of the adjustment screw whereas the retention of the adjustment screw in the turbomachine casing provides for a means to retain the diaphragm in the turbomachine casing. Further the combination of the bifurcated head on the support lug and the dumbbell shaped adjusting screw provides for positive retention of the diaphragm in the casing, while permitting thermal expansion and providing an improved sliding bearing surface.

While there has been shown what is considered to be the preferred embodiment of the invention, it is, of course, understood that various other modifications may be made therein by those skilled in the art. It is intended to cover, in the appended claims, all such modifications which fall within the true spirit and scope of the invention.

What is claimed is:

1. A support arrangement for supporting an annular diaphragm half into a turbomachine casing comprising:

at least two support lugs threaded into said diaphragm, one from each side of the machine axis centerline; said support lugs extending in a generally radial direction; each support lug having a bifurcated head section extending outwardly from said diaphragm;

at lease two adjusting bolts threaded into said turbomachine casing, one from each side of the machine axis centerline; said adjusting bolts each including an enlarged bearing platform and a cap portion having a reduced section there between, said reduced section for insertion into the bifurcated head section of its respective lug; and a locking tab connected to each cap portion for engaging said bifurcated head section whereby said adjusting bolt is locked in place.

* * * * *